United States Patent [19]

Frechin

[11] 4,014,757

[45] Mar. 29, 1977

[54] METHOD FOR PREPARING FIBROUS METAL MATERIALS BY ELECTROLYTIC DEPOSITION AND THE RESULTING FIBROUS METAL MATERIAL

[75] Inventor: Lucette Frechin, Darnac, France

[73] Assignee: Office National d'Etudes et de Recherches Aerospatiales (O.N.E.R.A.), Chatillon sous Bagneux, France

[22] Filed: Sept. 5, 1975

[21] Appl. No.: 610,762

[30] Foreign Application Priority Data

Sept. 17, 1974 France ..... 74.31399

[52] U.S. Cl. ..... 204/27; 204/214; 204/222

[51] Int. Cl.² ..... C25D 7/00; C25D 17/16; C25D 17/24

[58] Field of Search ..... 204/23, 27, 222, 214

[56] References Cited

UNITED STATES PATENTS

| | | | |
|---|---|---|---|
| 1,986,197 | 1/1935 | Harshaw | 204/37 R |
| 3,428,543 | 2/1969 | Weber | 204/23 |
| 3,498,890 | 3/1970 | Divecha et al. | 204/16 |
| 3,591,466 | 7/1971 | Heiman | 204/16 |

*Primary Examiner*—T. M. Tufariello
*Attorney, Agent, or Firm*—Larson, Taylor and Hinds

[57] ABSTRACT

In a procedure of preparing fibrous metal material by electrolytically depositing metal on conductive fibres forming a skeleton, the fibres are carded during deposition of the metal. The fibres are carded in a rotatable drum containing a fibre carding device which operates during rotation of the drum to card fibres while metal is being electrolytically deposited on the fibres.

6 Claims, 1 Drawing Figure

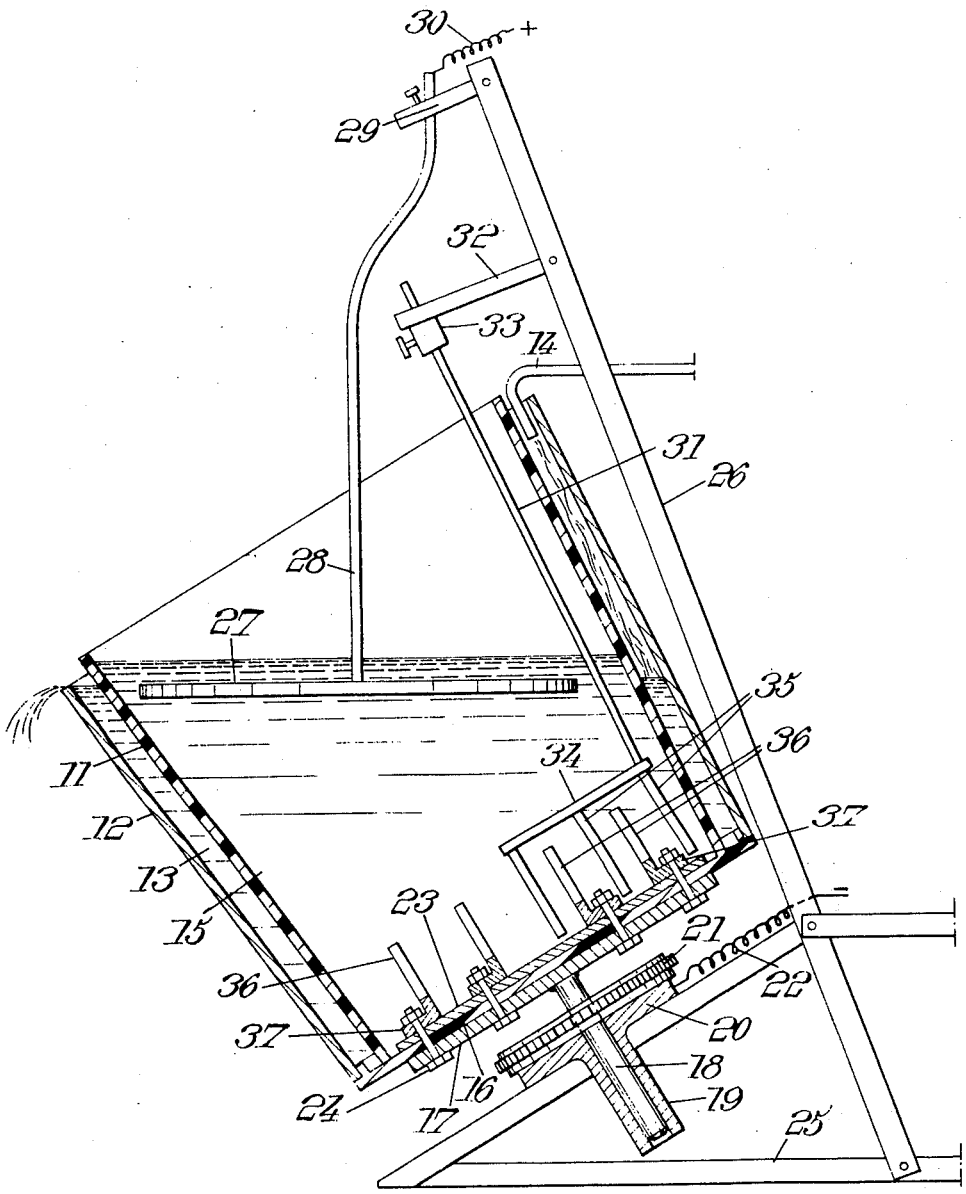
30
+
29
32
33
14
31
26
28
27
35
36
34
37
11
12
13
15
23
21
22
36
37
20
18
76
79
24
77
25

METHOD FOR PREPARING FIBROUS METAL MATERIALS BY ELECTROLYTIC DEPOSITION AND THE RESULTING FIBROUS METAL MATERIAL

The invention relates to a method of preparing fibrous metal material and to a device apparatus therefore. The present invention relates more particularly to an improvement to the method disclosed in British Patent Specification No. 1,307,254, to which this is an addition, and to electrolytic equipment for a method of operation described in the aforementioned Patent Specification. The invention also relates to the resulting fibrous metal material.

In the most general form of the method according to the aforementioned Patent Specification for obtaining a fibrous metal material, an electrically conductive carbon-fibre skeleton is formed, and a slightly electropositive metal or alloy is deposited on the fibres of the skeleton so as to form metal fibres having a carbon core, after which the carbon is eliminated by selective oxidation with heating. In one method of operation, the purpose of which is to obtain a metal felt or wadding, a conductive carbon wadding is made for example by pyrolysing crude cotton wool and heating it in a neutral atmosphere containing a hydrocarbon for producing pyrolytic bridges on the carbon fibres; next, the carbon wadding is broken into fragments and coated with nickel in an electrolytic drum of known kind containing a nickel bath. Carbon-core nickel-fibre wadding is thus obtained, in suspension in the electrolyte. The fibres are washed and drained for felting and then decarbonized as previously described.

The aforementioned method of electrolytic nickel-plating in a drum gives small cakes of very uniform fibres provided that the thickness of the deposited metal is less than a certain given limit. Above this limit, the wadding becomes non-uniform since the mixing of the bath and of the fibres produced by rotating the drum is no longer sufficient to prevent the nickel coating from coalescing at the points of contact between the fibres, and cannot prevent the resulting current-density gradients.

This undesirable phenomenon, incidentally, is not peculiar to nickel deposits on carbon fibres but occurs whenever metal coatings are deposited on conductive fibres by electrolysis in a drum.

An object of the present invention is to provide a method of preparing a fibrous metal material and a device suitable for use in preparing a fibrous metal material which overcomes or at least mitigates the previously mentioned disadvantages.

According to one aspect of the present invention there is provided a method of preparing a fibrous metal material, which method comprises carding conductive fibres, which fibres form a skeleton, whilst electrolytically depositing metal on the fibres.

According to a second aspect of the present invention there is provided a device suitable for use in preparing a fibrous metal material, which device comprises means for carding conductive fibres whilst metal is being electrolytically deposited on the fibres, which fibres form a skeleton.

The present invention enables the provision of metal fibres obtained by electrolysis in a drum which may have a much larger cross-section than the maximum possible obtainable without using the method according to the present invention.

In the method, fibres are carded preferably continuously during electrolysis, so that the points of contact between the fibres are shifted preferably continuously.

Preferably, the means, for carding conductive fibres comprises a rotatable drum and a fibre-carding device for positioning in the drum, which fibre-carding device is operatable during rotation of the drum. Advantageously the fibre-carding device comprises a comb for positioning in the rotatable drums such that the comb is substantially stationary during rotation of the drum and the teeth of which comb are substantially parallel to the axis of rotation of the drum, the free ends of the teeth being near an end of the drum, and finger-like projections for disposing in circles within the drum and for securing at said end of the drum such that the projections are substantially parallel to the axis of rotation of the drum the arrangement being such that, in use of the device, the finger-like projections move between the teeth of the comb during rotation of the drum thereby carding fibres situate in the drum. Preferably, the comb is made of insulating or insulated material.

For a better understanding of the present invention and to show how the same may be put into effect reference will now be made, by way of example, to the single accompanying FIGURE which shows a diagrammatic axial cross-sectional view through an electrolytic drum provided with a carding device according to the present invention. For the sake of clarity, the thicknesses of certain components have been considerably exaggerated.

The drum will be described briefly, since it is a known kind. A vessel 11 made of insulating or insulated material such as reinforced resin or sheet steel covered with a layer of insulating polymer, has an axis of rotation which is considerably inclined to the vertical. The vessel can be cylindrical but, in order to increase the anode surface, it should preferably have a flared shape, that is a truncated cone resting on its minor base. The vessel is surrounded by a collar 12 forming a jacket 13 through which water flows from a pipe 14 so as to maintain the bath of electrolyte 15 at a substantially constant temperature. The end 16 of vessel 11 is secured to a metal flange 17 borne by a shaft 18 engaging in a metal socket 19, the top part of which comprises a plate 20. A sprocket wheel 21 driven by a chain and a motor (not shown in the drawing) are secured to shaft 18. The bottom surface of wheel 21 bears on plate 20 and rubs against it during rotation, thus providing adequate electric contact. Plate 20 is connected to the negative current terminal by a conductor 22. The cathode surface is a circular plate 23 of steel, copper or brass, secured to end 16 by bolts 24, which also secure end 16 to flange 17. Plate 23 can be replaced by rings secured by bolts 24. Socket 19 is secured in a triangular holder 25 made of insulating material, for example wood.

Holder 25 is prolonged by an upper ascending member 26. The anode surface is a nickel plate 27 immersed in the top part of the bath near its free surface and held by a conductive rod 28 secured by a clamp 29 integral with member 26, the rod being connected to the positive current terminal by a conductor 30.

The carding device comprises a stationary comb secured to member 26 and immersed in the bath, and also comprises movable fingers secured to the end of the drum and moving between the comb teeth when the drum rotates. The comb comprises a sleeve 31 secured to member 26 by an arm 32 with interposition of a clamp 33 and immersed in the bath at a small distance from and substantially parallel to the top generatrix of drum 11. The bottom part of sleeve 31 ends in the back 34 of the comb, which is substantially parallel to the drum end in a radial direction and bears equidistant cylindrical teeth 35 which are parallel to the drum axis and the free ends of which are very close to cathode 23 though not in contact with it.

Cylindrical fingers 36 have spaces 37 which are secured to cathode 23 by bolts 24. They are disposed in circles at intervals equal to the space between teeth 35, and travel substantially at the centre of the intervals between the teeth.

All the comb and finger elements are made of insulating or insulated materials. The teeth and fingers can be made for example of polyamide resin or steel protected by a layer of resin.

The inclination of the drum axis with respect to the vertical is important. Experience shows that if the inclination is less than 20°, the mixing and carding of the fibres is inefficient. If the slope is greater than 40°, the volume of the bath becomes insufficient. Advantageously the slope is about 30°.

The following examples further illustrate the present invention.

In examples 1 and 2 the drum used has a useful capacity of 15 liters, allowing for the inclination of the axis. The inner diameter of the drum end is 240 mm. The drum has three teeth 35 with a spacing of 40 mm and a length of 70 mm. The fingers 36 are 60 mm long and are disposed in two circles, one having an average radius of 40 mm and comprising four fingers and the other having an average radius of 80 mm and comprising 8 fingers. Of course, these data are given by way of example only and can be considerably modified to allow for the drum capacity, the nature of the skeleton, the nature of the required deposit, and so on.

In order to evaluate the advance made by the invention, comparative tests were made relating to the maximum diameter of the resulting nickel fibres, that is the maximum thickness of nickel deposited, without substantial coalescence of the fibrous material, on a carbon fibre skeleton using the aforementioned drum with and without the carding device according to the invention. The carding device was used in example 1 but not in example 2. The deposited thickness was evaluated in each case by dividing the weight of carbon by the weight of nickel, that is by obtaining the C/Ni ratio of the resulting fibrous metal material.

The main constituent of the nickel-coating bath in both examples was nickel sulphamate in the proportion of 330 g per liter and at a temperature of about 45° C, the applied voltage being from 8 to 10 V and the current being 50 A. Example 2 showed that it is impossible, to obtain a C/Ni ratio less than 0.15 or 0.16. Below this value, the fibres form non-uniform cakes. Example 1 showed that using the carding device according to the present invention, the C/Ni ratio can be reduced to 0.07 or even 0.03.

The invention is not restricted to the deposition of nickel on to carbon fibres. It can be applied to the deposition of other metals on to other skeletons, provided allowance is made for the relative electropositivity. For example, lead fibres can be formed "in the drum" by processing carbon fibres with lead fluoborate in an electrolytic bath. It has hitherto been thought impossible to obtain such fibres by electrolytic deposition.

What is claimed is:

1. In a process for preparing fibrous metal material wherein the metal is electrolytically deposited on conductive fibres forming a skeleton, the improvement comprising continuously carding the fibres during deposition of the metal thereof, said carding comprising subjecting said fibres to the action of at least two sets of teeth in relative movement with respect to each other.

2. The process of claim 1, in which the fibres of the skeleton are carbon fibres, the metal being deposited being nickel.

3. The process of claim 1, in which the fibres of the skeleton are carbon fibres, the metal being deposited being lead.

4. The process of claim 1, in which the fibres are situate in a rotating drum and a fibre-carding device in the drum operates during rotation thereof to card the fibres.

5. Carbon-core metal fibres which comprises metal electrolytically deposited on conductive fibres forming a skeleton, the fibres having been carded during deposition of the metal.

6. The fibres of claim 5, in which the carbon-core metal fibres are carbon-core nickel fibres, the ratio by weight of carbon to nickel being substantially lower than 0.15.

* * * * *